US007760901B2

(12) United States Patent
Kaiya et al.

(10) Patent No.: US 7,760,901 B2
(45) **Date of Patent: *Jul. 20, 2010**

(54) SPEAKER DEVICE AND MANUFACTURING METHOD THEREOF

(75) Inventors: Teruaki Kaiya, Yamagata (JP); Seiya Sato, Yamagata (JP)

(73) Assignees: Pioneer Corporation, Tokyo (JP); Tohoku Pioneer Corporation, Tendo-Shi (JP)

( * ) Notice: Subject to any disclaimer, the term of this patent is extended or adjusted under 35 U.S.C. 154(b) by 1303 days.

This patent is subject to a terminal disclaimer.

(21) Appl. No.: 11/257,129

(22) Filed: Oct. 25, 2005

(65) Prior Publication Data

US 2006/0088181 A1 Apr. 27, 2006

(30) Foreign Application Priority Data

Oct. 25, 2004 (JP) ..... 2004-309794

(51) Int. Cl.
*H04R 25/00* (2006.01)

(52) U.S. Cl. ..... 381/404; 381/396; 381/407

(58) Field of Classification Search ..... 381/396–398, 381/400, 404, 407, 411
See application file for complete search history.

(56) References Cited

U.S. PATENT DOCUMENTS 4,118,605 A * 10/1978 Kobayashi ..... 381/407
5,249,236 A 9/1993 Sakamoto
6,118,884 A * 9/2000 Proni ..... 381/403
7,394,913 B2 * 7/2008 Matsuda et al. ..... 381/400
7,515,727 B2 * 4/2009 Watanabe ..... 381/396
2004/0179711 A1 9/2004 Park

FOREIGN PATENT DOCUMENTS

| | | |
|---|---|---|
| EP | 0 610 769 | 8/1994 |
| EP | 0 622 970 | 11/1994 |
| JP | 57-113598 | 7/1982 |
| JP | 3-42798 | 1/1986 |
| JP | 4-369999 | 12/1992 |
| JP | 04 369999 | 12/1992 |
| JP | 7-154895 | 6/1995 |
| JP | 10-210593 | 8/1998 |
| JP | 11-27795 | 1/1999 |
| JP | 11 027795 | 1/1999 |
| JP | 2000-244999 | 9/2000 |
| JP | 2000-350290 | 12/2000 |
| JP | 2000 244999 | 1/2001 |
| JP | 2005 269335 | 9/2005 |
| JP | 2005-269335 | 9/2005 |
| WO | 02/19763 | 3/2002 |

* cited by examiner

*Primary Examiner*—Suhan Ni
(74) *Attorney, Agent, or Firm*—Young & Thompson

(57) ABSTRACT

A speaker device includes a magnetic circuit system and a vibration system. The vibration system has a voice coil bobbin, a voice coil wound therearound, a damper, an annular member, a diaphragm and one additional annular member fixed to the voice coil via an adhesive. In the vibration system, the additional annular member and the annular member are arranged on the lower side of the damper and on the upper side of the damper, respectively. A flat portion in the vicinity of the inner peripheral edge portion of the damper is sandwiched between the additional annular member and the annular member.

5 Claims, 14 Drawing Sheets

SPEAKER DEVICE AND MANUFACTURING METHOD THEREOF

BACKGROUND OF THE INVENTION

1. Field of the Invention

The present invention relates to a mounting structure of a damper and the like in a speaker device.

2. Description of Related Art

Conventionally, there is known an external-magnet type speaker device including a vibration system having a damper, a diaphragm, a voice coil and a voice coil bobbin, and a magnetic circuit system having a yoke, an annular magnet and an annular plate.

Such a speaker device has a configuration in which inner peripheral edge portions of the damper and the diaphragm are mounted on an outer peripheral wall of the voice coil wound around the voice coil bobbin (or an outer peripheral wall of the voice coil bobbin) via an adhesive, respectively, for example. An example of the speaker device having the kind of form is disclosed in Japanese Patent Applications Laid-open under No. 2000-350290 and No. 10-210593.

In addition, as another example, there is known a configuration as follows: for the purpose of improving mounting strength of the damper to the voice coil (or the voice coil bobbin), based on the configuration of the above-mentioned speaker device, an annular resin member is further arranged on a lower side of the damper, and the inner peripheral edge portion of the damper, the inner peripheral edge portion of the resin member and the outer peripheral wall of the voice coil (or the voice coil bobbin) are bonded by the adhesive, respectively. An example of the speaker device having this kind of form is disclosed in Japanese Patent Application Laid-open under No. 2000-244999.

There is known a speaker device including a dump ring made of a soft material on a backward inner peripheral end of a spider for the purpose of absorbing an impact caused due to contact of the spider to the plate (for example, see Japanese Utility Model Publication No. 3-42798).

However, in the above-mentioned speaker device, at the time of large magnitude signal input, the damper is problematically cut at a border portion of the inner peripheral edge portion of the damper and the adhesive or problematically peels off the adhesive. This is caused mainly because a portion of the damper which is not fixed by the adhesive widely vibrates with respect to the border portion. In addition, in such a speaker device, since an adhesion area of the adhesive applied between the inner peripheral edge portions of the damper and the diaphragm and the outer peripheral wall of the voice coil (or the voice coil bobbin) is small, there is a problem that the adhesive between the damper and the voice coil (or the voice coil bobbin) peels at the time of the large magnitude signal input to the speaker device and the voice coil (or the voice coil bobbin) peels off the damper.

SUMMARY OF THE INVENTION

The present invention has been achieved in order to solve the above problems. It is an object of this invention to provide a speaker device and a manufacturing method thereof capable of preventing problems, such as cutting and peeling of a damper and peeling of a voice coil bobbin from the damper, at a time of large magnitude signal input to the speaker device.

According to one aspect of the present invention, there is provided a speaker device including: a voice coil bobbin; a diaphragm which is fixed to the voice coil bobbin via an adhesive; a damper; and an annular member, wherein the annular member is arranged between the diaphragm and the damper. The above speaker device includes the voice coil bobbin, the diaphragm fixed to the voice coil bobbin via the adhesive, the damper and the annular member formed into the annular shape. The annular member is preferably formed by a resin material, for example.

In a generally known speaker device (hereinafter, also referred to as "normal speaker device"), the inner peripheral portion of the diaphragm is arranged in the vicinity of the inner peripheral portion of the damper, and the inner peripheral portion of the damper and the inner peripheral portion of the diaphragm are fixed to the voice coil bobbin via the adhesive. Therefore, in the normal speaker device, the adhesion area of the adhesive applied between the voice coil bobbin and each of the inner peripheral portions of the damper and the diaphragm approximately becomes a value obtained by multiplying a distance from the inner peripheral portion of the damper to the inner peripheral portion of the diaphragm positioned in the vicinity of the inner peripheral portion of the damper by a length of an outer circumference of the voice coil bobbin. Therefore, the adhesion area is small, and bonding strength of the damper, the diaphragm and the voice coil bobbin is not so strong. Thus, when the voice coil bobbin and the like vibrate with the large magnitude, the adhesive among the damper, the diaphragm and the voice coil bobbin peels off, and the voice coil bobbin may peel off the damper and the diaphragm.

On the other hand, in the above-mentioned speaker device, the annular member is arranged between the damper and the diaphragm to be fixed to the voice coil bobbin via the adhesive. Therefore, the adhesion area of the adhesive applied among the damper, the annular member, the diaphragm and the voice coil bobbin becomes larger than the adhesion area of the above-mentioned normal speaker device, and adhesion strength thereof is large. Thus, even when the voice coil bobbin vibrates with the large magnitude, the adhesive among the damper, the annular member, the diaphragm and the voice coil bobbin hardly peels off. Hence, it can be prevented that the voice coil bobbin peels off the damper, the annular member and the diaphragm.

In a form of the above speaker device, a gap may be formed among the damper, the annular member and the voice coil bobbin, the adhesive may be filled into the gap, and the damper and the annular member may contact at an outer peripheral position of the annular member adjacent to the gap via no adhesive.

In accordance with the form, the gap is formed among the damper, the annular member and the voice coil bobbin, and the adhesive is filled into the gap. Therefore, the damper, the annular member and the voice coil bobbin are fixed by the adhesive, respectively. In addition, the damper and the annular member contact at the position adjacent to the gap into which the adhesive is filled and at the outer peripheral position of the annular member via no adhesive, Thus, the adhesive filled into the gap does not reach the contact portion of the damper and the annular member, and the annular member and the damper directly contact. Thereby, even when the voice coil bobbin vibrates with the large magnitude, it can be prevented that the damper peels off the adhesive.

In a preferred example, a section of the outer peripheral portion of the annular member, contacting the damper, may be formed into a curve shape. Thereby, when the voice coil bobbin vibrates with the large magnitude and the damper widely moves onto the side of the annular member, since the damper corresponding to the outer peripheral portion of the annular member moves along the shape (curve shape) of the outer peripheral portion of the annular member, it can be prevented that the damper is cut nearby. Hence, the above speaker device can improve withstand input performance, and can be preferably used as a so-called subwoofer-type speaker device.

In another form of the above speaker device, the speaker device may further include: one additional annular member which is arranged on a side opposite to the annular member with respect to the damper, and which is fixed to the voice coil bobbin via an adhesive, wherein one additional gap is formed among the damper, the additional annular member and the voice coil bobbin, and the adhesive is filled into the additional gap, wherein the damper and the additional annular member contact at an outer peripheral position of the additional annular member adjacent to the other gap via no adhesive, and wherein the damper is sandwiched by the annular member and the additional annular member at the outer peripheral positions of the annular member and the additional annular member. In a preferred example, the outer peripheral portion of the additional annular member, contacting the damper, may be formed into a curve shape.

In accordance with the form, the speaker device includes the additional annular member which is arranged on the side opposite to the annular member arranged on the upper side of the damper, i.e., on the lower side of the damper, and is fixed to the voice coil bobbin via the adhesive. The gap is formed among the dampers the additional annular member and the voice coil bobbin, and the adhesive is filled into the gap. Therefore, the damper, the additional annular member and the voice coil bobbin are fixed by the adhesive, respectively. In addition, the damper and the additional annular member contact at the outer peripheral position of the additional annular member adjacent to the gap via no adhesive. Further, the damper is sandwiched between the annular member and the additional annular member at the outer peripheral positions of the annular member and the additional annular member. Therefore, the adhesive filled into the gap does not reach the contact portion of the damper and the additional annular member, and the damper and the additional annular member directly contact. Thereby, even when the voice coil bobbin vibrates with the large magnitude, it can be prevented that the damper peels off the adhesive.

In a preferred example, a section of the outer peripheral portion of the additional annular member, contacting the damper, may be formed into a curve shape. Thereby, when the voice coil bobbin vibrates with the large magnitude, since the damper corresponding to the outer peripheral portion of the additional annular member moves along the shape (curve shape) of the outer peripheral portion of the annular member and the shape (curve shape) of the outer peripheral portion of the additional annular member, it can be prevented that the damper is cut nearby.

In addition, in such a form, since in addition to the annular member, the additional annular member is fixed to the voice coil bobbin and the like by the adhesive, the adhesion area of the adhesive applied among the additional annular member, the damper, the annular member, the diaphragm and the voice coil bobbin becomes larger. Therefore, even when the voice coil bobbin vibrates with the large magnitude, the adhesive among the additional annular member, the damper, the annular member, the diaphragm and the voice coil bobbin hardly peels off, and it can be prevented that the voice coil bobbin peels off the additional annular member, the damper, the annular member and the diaphragm.

In still another form of the above speaker device, the speaker device may further include: plural tinsel cords which supply an electric signal; and a voice coil which is wound around the voice coil bobbin, wherein plural groove portions are formed on the annular member, and wherein the plural tinsel cords are inserted into plural correspondent groove portions and are electrically connected to the voice coil.

In accordance with the form, the speaker device includes the plural tinsel cords supplying the electric signal and the voice coil wound around the voice coil bobbin. The plural groove portions (cutting portions) are formed on the annular member, and the plural tinsel cords are inserted into the plural correspondent grove portions to be electrically connected to the voice coil. Namely, since the plural groove portions are formed on the annular member, there is such an advantage that the plural tinsel cords and the voice coil can be easily electrically connected via solder for example, at the time of manufacturing the speaker device.

In a preferred example, the diaphragm, the damper, the annular member and the additional annular member may be fixed to the voice coil bobbin via the voice coil by the adhesive, respectively. Namely, the diaphragm, the damper, the annular member and the additional annular member are not directly fixed to the voice coil bobbin by the adhesive. They can be fixed to the voice coil bobbin via the voice coil by the adhesive, respectively.

According to another aspect of the present invention, there is provided a manufacturing method of a speaker device including: a damper fixing process which arranges an inner peripheral portion of a damper on an outer peripheral wall of a voice coil bobbin and fixes the inner peripheral portion of the damper on the outer peripheral wall of the voice coil bobbin by an adhesive; an annular member fixing process which arranges an annular member on an upper side of the damper to make a portion of the inner peripheral portion of the damper and a portion of the annular member contact, and fixes the annular member to the inner peripheral portion of the damper and the outer peripheral wall of the voice coil bobbin via the adhesive; and a diaphragm fixing process which applies an adhesive to one portion of an inner peripheral portion and an upper surface of the annular member, arranges an inner peripheral portion of a diaphragm on an upper side of the annular member, fixes an inner peripheral edge portion of the diaphragm and the annular member by the adhesive, and applies an adhesive between the inner peripheral portion of the diaphragm and the outer peripheral wall of the voice coil bobbin to fix the inner peripheral portion of the diaphragm and the outer peripheral wall of the voice coil by the adhesive.

In accordance with the above manufacturing method of the speaker device, the damper fixing process arranges the inner peripheral portion of the damper on the outer peripheral wall of the voice coil bobbin, and the inner peripheral portion of the damper is fixed to the outer peripheral wall of the voice coil bobbin by the adhesive. In the annular member fixing process serving as the subsequent process, the annular member is arranged on the upper side of the damper, and the one portion of the inner peripheral portion of the damper and the one portion of the annular member are contacted. At the same time, the annular member is fixed to the inner peripheral portion of the damper and the outer peripheral wall of the voice coil bobbin via the above adhesive. In the diaphragm fixing process serving as the subsequent process, the adhesive is applied to the one portion of the inner peripheral portion and the upper surface of the annular member. At the same time, the inner peripheral portion of the diaphragm is arranged on the upper side of the annular member, and the inner peripheral edge portion of the diaphragm and the annular member are fixed by the adhesive. Then the adhesive is applied between the inner peripheral portion of the diaphragm and the outer peripheral wall of the voice coil bobbin, and the inner peripheral portion of the diaphragm and the outer peripheral wall of the voice coil are fixed by the adhesive. In such a method, the above speaker device can be obtained.

A form of the above manufacturing method of the speaker device may further include: a temporary attachment process which arranges one additional annular member on the outer peripheral wall of the voice coil bobbin corresponding to a lower side of the damper, and applies an adhesive for temporary attachment between an inner peripheral edge portion on a lower surface of the additional annular member and the outer peripheral wall of the voice coil bobbin to temporarily attach the additional annular member to an appropriate position of the outer peripheral wall of the voice coil bobbin, in a preceding process of the damper fixing process, wherein the damper fixing process applies an adhesive on one portion of an upper surface and an inner peripheral portion of the additional annular member and the outer peripheral wall of the voice coil bobbin corresponding to a vicinity of an inner peripheral edge portion of the additional annular member to make the one portion of the upper surface of the additional annular member and one portion of a lower surface of the damper contact, and fixes the additional annular member and the damper by an adhesive, respectively.

In accordance with the form, in the temporary attachment process serving as the preceding process of the damper fixing process, the additional annular member is arranged on the outer peripheral wall of the voice coil bobbin corresponding to the lower side of the damper. Moreover, the adhesive for temporary attachment is applied between the inner peripheral edge portion of the lower side of the additional annular member and the outer peripheral wall of the voice coil bobbin, and the additional annular member is temporarily attached to the appropriate position of the outer peripheral wall of the voice coil bobbin. Thereby, the additional annular member is temporarily attached to the appropriate position of the outer peripheral wall of the voice coil bobbin. In the damper fixing process serving as the subsequent process, the adhesive is applied to the one portion of the upper surface and the inner peripheral portion of the additional annular member and the outer peripheral wall of the voice coil bobbin corresponding to the vicinity of the inner peripheral edge portion of the additional annular member, and the one portion of the upper surface of the additional annular member and the one portion of the lower surface of the damper are contacted. Further, the additional annular member and the damper are fixed by the adhesive, respectively.

Another form of the above manufacturing method of the speaker device may further include: a process which winds a voice coil around the voice coil bobbin; a connecting process which inserts plural tinsel cords electrically connected to an amplifier into plural correspondent groove portions of the annular member to electrically connect the plural tinsel cords and the voice coil, between the annular member fixing process and the diaphragm fixing process.

In accordance with the form, the above method includes the process of winding the voice coil around the voice coil bobbin. Thereby, the voice coil is wound around the voice coil bobbin. In addition, the above method includes the connection process between the annular member fixing process and the diaphragm fixing process. Namely, in the connection process, the plural tinsel cords electrically connected to the amplifier are inserted into the plural groove portions of the correspondent annular member, and the plural tinsel cords and the voice coil are electrically connected. Thereby, the plural tinsel cords and the voice coil can be easily electrically connected.

In a preferred example, the additional annular member fixing process, the damper fixing process, the annular member fixing process and the diaphragm fixing process may fix respective components to the outer peripheral wall of the voice coil bobbin by an adhesive via the voice coil, respectively. By the respective processes, the additional annular member, the damper, the annular member and the diaphragm are fixed to the voice coil bobbin via the voice coil by the adhesive, respectively.

The nature, utility, and further features of this invention will be more clearly apparent from the following detailed description with respect to preferred embodiment of the invention when read in conjunction with the accompanying drawings briefly described below.

DETAILED DESCRIPTION OF THE PREFERRED EMBODIMENTS

The preferred embodiments of the present invention will now be described below with reference to the attached drawings. Each embodiment prevents the damper from being cut and peeling and the voice coil bobbin from peeling off the damper and the like at the time of the vibration of the speaker device with the large magnitude.

First Embodiment (Configuration of Speaker Device)

Figure 1:
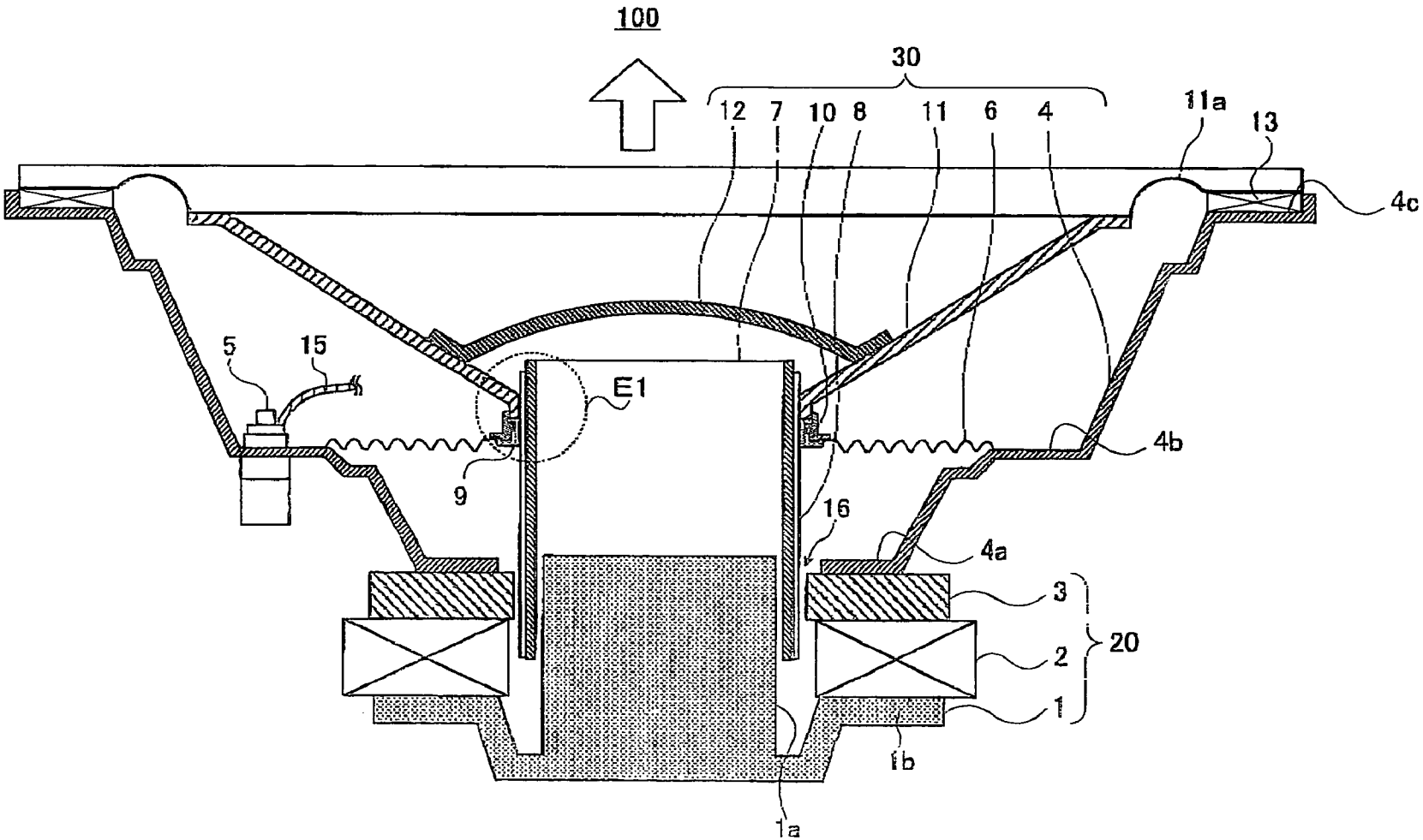
FIG. 1 shows a cross-sectional view of a speaker device according to a first embodiment of the present invention.

FIG. 1 schematically shows a configuration of a speaker device 100 according to an embodiment of the present invention. The speaker device 100 of this embodiment is the so-called subwoofer-type speaker device. In addition, the speaker device 100 of this embodiment can be preferably used as an on-vehicle speaker. FIG. 1 shows a cross-sectional view when cutting the speaker device 100 by a plane including a central axis thereof. The description will be given of the configuration of the speaker device 100 of this embodiment with reference to FIG. 1, below.

As shown in FIG. 1, the speaker device 100 mainly includes a magnetic circuit system 20 having a yoke 1, a magnet 2 and a plate 3, a vibration system 30 having a frame 4, a damper 6, a voice coil bobbin 7, a voice coil 8, an annular member 10, a diaphragm 11 and a dustproof cap 12, and plural terminal members 5, plural tinsel cords 15 and a buffer member 13 as various kinds of members.

First, the description will be given of respective components of the magnetic circuit system 20.

The magnetic circuit system 20 is configured as an external-magnet type magnetic circuit. The yoke 1 has a cylindrical pole portion 1*a* and a flange portion 1*b* extending in an outward direction from a lower end portion of an outer peripheral wall thereof. The annular magnet 2 is fined onto an upper surface of the flange portion 1*b* being the component of the yoke 1. The annular plate 3 is fixed onto the annular magnet 2. In the magnetic circuit system 20, the magnetic circuit is constructed by the magnet 2 and the plate 3, and magnetic flux of the magnet 2 concentrates on a magnetic gap 16 formed between an inner peripheral wall of the plate 3 and an outer peripheral wall of the pole portion 1*a*.

Next, the description will be given of respective components of the vibration system 30.

The various components of the speaker device 100 are fixed onto the frame 4, and the frame 4 serves as supporting member of the components. The frame 4 has a first flat portion 4*a*, a second flat portion 4*b* and a third flat portion 4*c*, whose upper surfaces ensure flatness. The first flat portion 4*a* is formed at a position on the lower side of the frame 4. The lower surface of the first flat portion 4*a* is fixed onto the annular magnet 3. The second flat portion 4*b* is formed at a substantial middle position of the frame 4. Onto an upper surface of the second flat portion 4*b*, the outer peripheral edge portion of the damper 6 is fixed. The third flat portion 4*c* is formed at a position on an upper side of the frame 4. Onto an upper surface of the third flat portion 4*c*, the annular buffer member 13 is mounted. The buffer member 13 is preferably a material such as a sponge, and has a function of preventing an unnecessary vibration from the frame 4 from being transmitted to the diaphragm 11.

The voice coil bobbin 7 is formed into a substantially cylindrical shape. The voice coil 8, which will be described later, is wound around the outer peripheral wall of the voice coil bobbin 7. The vicinity of the lower end portion of the outer peripheral wall of the voice coil bobbin 7 is opposite to each of the inner peripheral walls of the annular magnet 2 and plate 3 via the voice coil 8 with a constant space therebetween. On the other hand, the vicinity of the lower end portion of the inner peripheral wall of the voice coil bobbin 7 is opposite to the vicinity of the upper end portion of the outer peripheral wall of the pole portion 1*a* with a constant space. A gap (magnetic gap 16) is formed between the vicinity of the upper end portion of the outer peripheral wall of the pole portion 1*a* and the inner peripheral wall of the plate 3.

The voice coil 8 has a pair of positive/negative lead wires (not shown) A lead wire at the positive side is an input wiring for an L (or R) channel signal, and a lead wire at the negative side is an input wiring for a ground (GND: ground) signal. Each of the lead wires is electrically connected to each of tinsel cords (not shown), and each of the tinsel cords 15 is electrically connected to one end side of each terminal member 5 mounted onto the upper surface of the second flat portion 4*b* of the frame 4. On the other hand, the other end side of each terminal member 5 is electrically connected to each input wiring of the amplifier. Therefore, the electric signal of one channel is inputted to the voice coil a from the amplifier via each of terminal members 5, each of the tinsel cords 15 and each of the lead wires.

The damper 6 is formed into an annular shape, and has an elastic portion formed with concentric corrugations. The outer peripheral edge portion of the damper 6 is fixed onto the second flat portion 4*b* of the frame 4, and the inner peripheral edge portion of the damper 6 is fixed to the outer peripheral wall of the voice coil 8.

The annular member 10, which characterizes the present invention, is mounted onto the outer peripheral wall of the voice coil 8 and the like via an adhesive 9. The detailed configuration of the annular member 10 will be described later.

The diaphragm 11 is formed into a cone shape. Various kinds of materials such as paper, high polymer and metal can be applied to the diaphragm 11 in accordance with the various use purposes. An edge 11*a* is formed at the outer peripheral edge portion of the diaphragm 11. The lower surface of the outer peripheral edge portion of the edge 11*a* is mounded onto the upper surface of the annular buffer member 13, and is opposite to the upper surface of the third flat portion 4*c* of the frame 4.

The dustproof cap 12 is fixed onto the upper surface of the diaphragm 11 at the vicinity of the inner peripheral edge portion thereof in order to cover the upper surface of the voice coil bobbin 7. Therefore, the dustproof cap 12 has a function of preventing dust and the like from entering the inside of the speaker device 100.

In the speaker device 100 which is described above, the electric signal outputted from the amplifier is supplied to the voice coil 8 via each of the terminal portions 5, each of the tinsel cords 15 and each leadwire. Thereby, driving force occurs to the voice coil 8 in the magnetic gap 16, and vibrates the diaphragm 11 in the axial direction of the speaker device 100. Thus, the speaker device 100 emits acoustic waves in the direction of an arrow shown in FIG. 1.

(Mounting Structure of Damper)

Figure 2B:
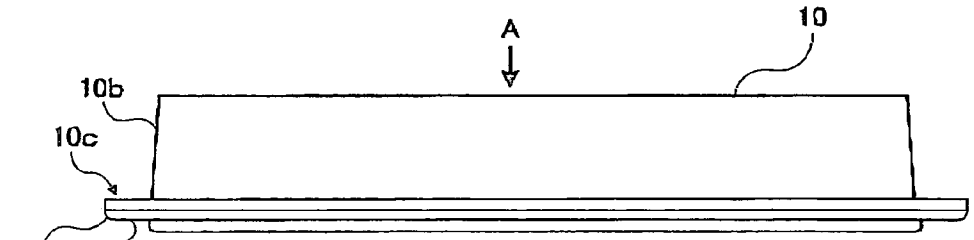
FIGS. 2A to 2C show a perspective view, a side view and a plan view of an annular member of the present invention, respectively.
Figure 2C:
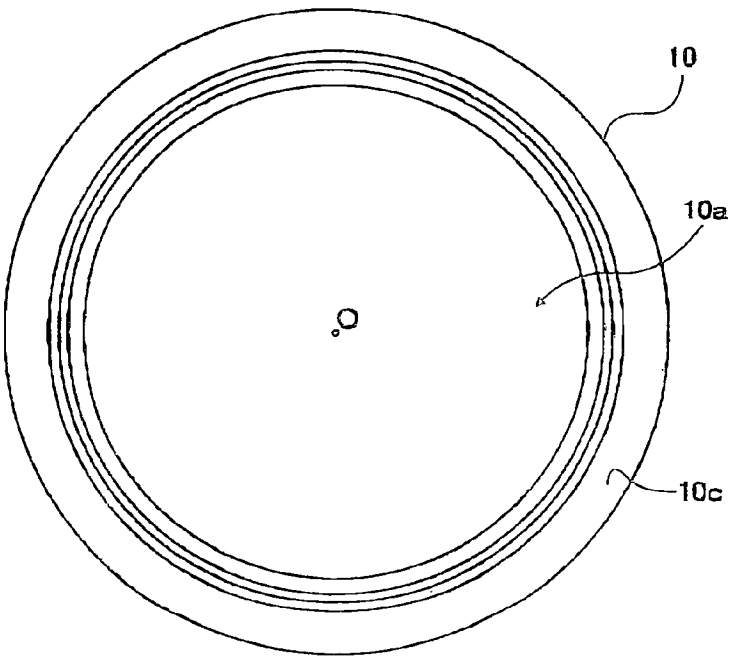
Figure 2A:
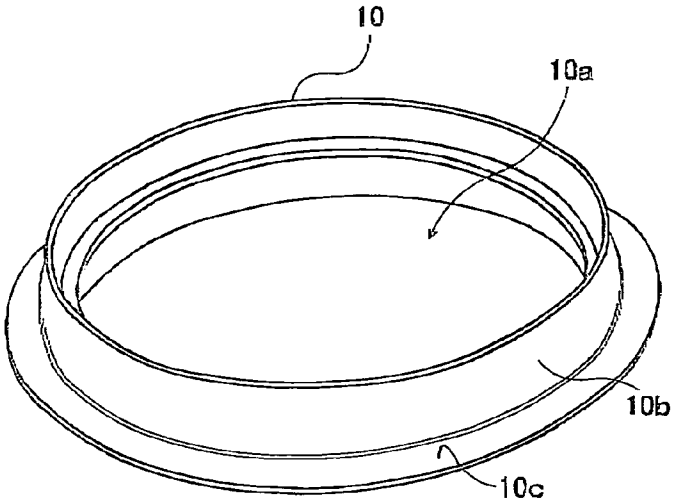
Figure 3B:
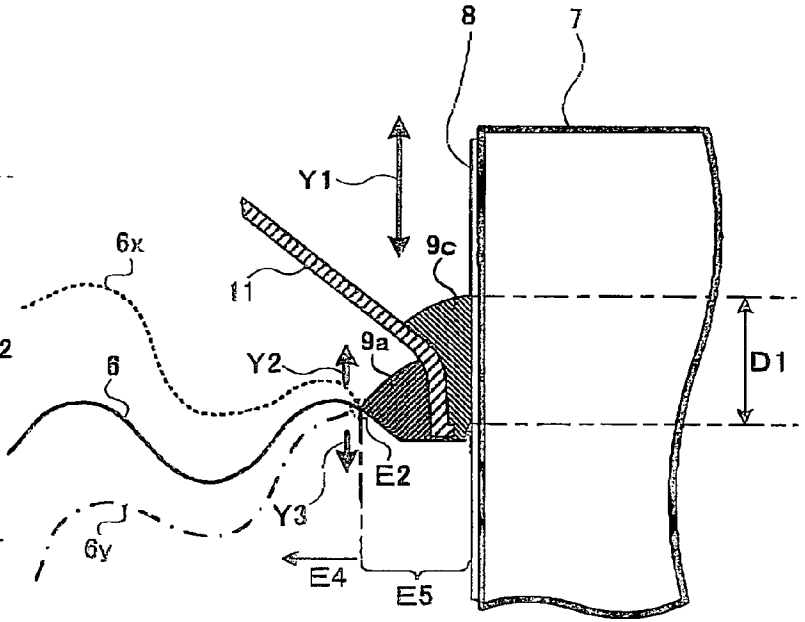
FIGS. 3A and 3B show cross-sectional views of a mounting structure of a damper and the like according to the first embodiment and a comparative example.
Figure 3A:
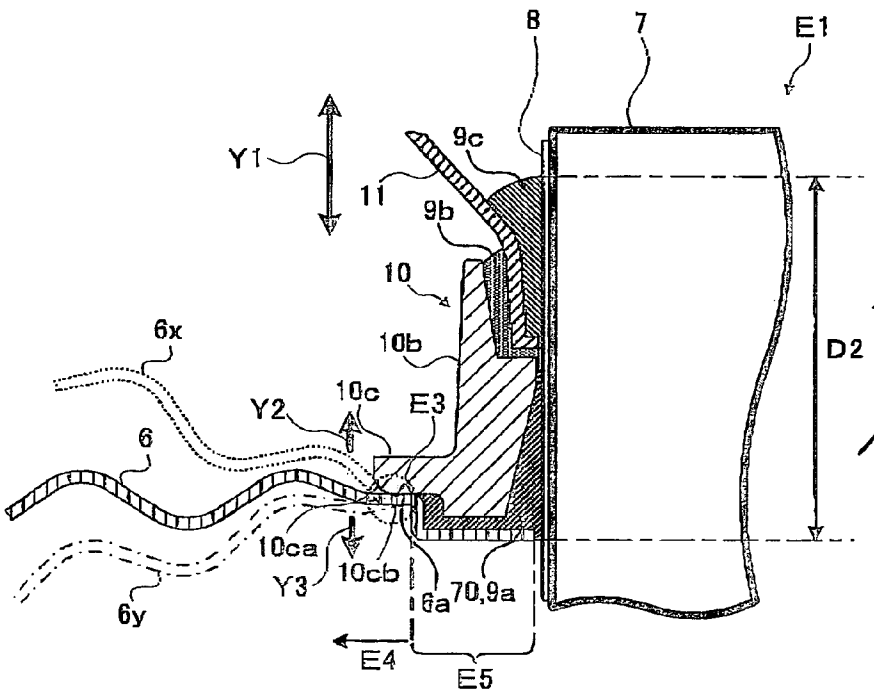

Next, the description will be given of a mounting structure of the damper 6, which is a characteristic of the present invention, with reference to FIGS. 2A to 2C and FIGS. 3A and 3B. FIGS. 2A to 2C show the configuration of the annular member 10 which is the characteristic of the present invention. FIG. 2A shows a perspective view of the annular member 10, FIG. 2B shows a side view of the annular member 10 and FIG. 2*c* shows a plan view of the annular member 10 of FIG. 2B observed in a direction of an arrow A, respectively. FIG. 3A is a partly cross-sectional view corresponding to the vicinity of a broken line area E1 in FIG. 1. In addition, FIG. 3A is the partly cross-sectional view showing the mounting structure of the damper 6, which is the characteristic of the present invention. FIG. 3B is a partly cross-sectional view showing the mounting structure of the damper 6 according to a comparative example corresponding to FIG. 3A.

First, the description will be given the configuration of the annular member 10 being the characteristic of the present invention, with reference to FIGS. 2A to 2C.

The annular member 10 has an opening 10*a*, a raised wall 10*b* and a flange portion 10*c*. The raised wall 10*b* is formed into a substantially cylindrical shape. Therefore, on the inner side of the annular member 10, the opening 10*a* is formed. The opening 10*a* is formed to have a diameter slightly larger than an outer diameter of the voice coil bobbin 7. The flange portion 10*c* extends opposite to the side of a central point O from the vicinity of the lower end portion of the outer peripheral wall of the raised wall 10*b*. A lower surface 10*cb* of the flange portion 10*c* has flatness. As shown in FIG. 2B, the outer peripheral edge portion 10*ca* of the lower surface 10*cb* of the flange portion 10*c* is chamfered and formed into a curve shape.

Next, the detailed description will be given of the mounting structure of the damper 6 with reference to FIG. 3A.

The voice coil 8 is wound around the outer peripheral wall of the voice coil bobbin 7. Particularly, the annular member 10 being the characteristic of the present invention is arranged between the inner peripheral edge portion of the damper 6 and the inner peripheral edge portion of the diaphragm 11. Specifically, the annular member 10 is arranged onto the upper side of the inner peripheral edge portion of the damper 6. A gap 70 is formed among the vicinity of the inner peripheral edge portion of the damper 6, the annular member 10 and the outer peripheral wall of the voice coil a, and an adhesive 9*a* is filled into the gap 70. Thereby, the inner peripheral edge portion of the damper 6, the annular member 10 and the outer peripheral wall of the voice coil 8 are connected to each other. In addition, on the upper side of the annular member 10, the inner peripheral edge portion of the diaphragm 11 is arranged. The annular member 10, the inner peripheral edge portion of the diaphragm 11 on the side of the annular member 10, and the outer peripheral wall of the voice coil 8 are connected to each other by an adhesive 9*b*, and the outer peripheral wall of the voice coil 8 and the inner peripheral edge portion of the diaphragm 11 on the side of the voice coil 8 are connected by an adhesive 9*c*.

The damper 6 has a flat portion 6*a* in the vicinity of the inner peripheral edge portion thereof, and the upper surface of the flat portion 6*a* has flatness. As shown in a broken line area E3 of FIG. 3A, the upper surface of the flat portion 6*a* contacts the lower surface 10*cb* of the flange portion 10*c* of the annular member 10 so that the adhesive 9*a* filled into the gap 70 does not flow out to the side of the lower surface 10*ca* of the flange portion 10*c*. The adhesive 9*a* is not applied between the upper surface of the flat portion 6*a* of the damper 6 and the lower surface 10*cb* of the flange portion 10*c* corresponding to the broken line area E3. Namely, the damper 6*a* and the annular member 10 are bonded by the adhesive 9*a* at the inner circumference side of the position at which the upper surface of the damper 6*a* and the lower surface 10*cb* of the flange portion 10*c* contact with each other. As a result, the upper surface of the damper 6*a* and the lower surface 10*cb* of the flange portion 10*c* are fixed in a manner in contact with each other. In addition, since the damper 6, the annular member 10 and the diaphragm 11 are bonded to the outer peripheral wall of the voice coil 8 via the adhesives 9*a*, 9*b* and 9*c*, the adhesion area to which the adhesives are applied approximately becomes a value obtained by multiplying a length D2 from the vicinity of the inner peripheral edge portion of the diaphragm 11 to the inner peripheral edge portion of the damper 6 by a length of the outer circumference of the voice coil 8.

Next, the description will be given of characteristic operation and effect of the present invention in comparison with the comparative example. The configuration of the comparative example is basically the same as the configuration of the present invention, but the mounting structure of the damper 6 according to the comparative example is different from the mounting structure of the present invention. Namely, the comparative example is different from the present invention in that the structure of the comparative example does not have the annular member 10 of the present invention. Therefore, in the comparative example, the same reference numerals are given to the same components as the components of the present invention, and explanation and illustrations thereof are simplified.

First, the configuration of the comparative example will be explained with reference to FIG. 3B.

In the comparative example, the voice coil 8 is wound around the outer peripheral wall of the voice coil bobbin 7. The inner peripheral edge portion of the damper 6 is arranged at the position in the vicinity of the inner peripheral edge portion of the diaphragm 11, and each of the inner peripheral edge portions of the damper 6 and the diaphragm 11 is bonded to the outer peripheral wall of the voice coil 8 via the adhesives 9*a* and 9*c*, respectively. In addition, the inner peripheral edge portion of the damper 6 and the inner peripheral edge portion of the diaphragm 11 are bonded by the adhesive 9*a*. The outer peripheral edge portion of the damper 6, which is not shown, is fixed onto the upper surface of the second flat portion 4*b* of the frame 4, similarly to the present invention. According to the above-mentioned structure, the adhesion area of the adhesives 9*a* and 9*c* applied among the damper 6, the diaphragm 11 and the outer peripheral wall of the voice coil 8 approximately becomes the value obtained by multiplying a length D1 (<D2) by the length of the outer circumference of the voice coil 8.

In the speaker device of the comparative example having such a configuration, when the voice coil bobbin 7 and the like are assumed to move in a direction of an arrow Y1 at the time of driving the speaker device, the inner peripheral edge portion of the damper 6 accordingly moves in the same direction. In FIG. 3B, while the portion of the damper 6 corresponding to an area E5 is fixed by the adhesive 9*a*, the portion of the damper 6 corresponding to an area E4 is not fixed by the adhesive 9*a*. Therefore, when the voice coil bobbin 7 and the like vibrate with the large magnitude, the portion of the damper 6 corresponding to the area E4 widely moves in the direction of the arrow Y1 with respect to a border portion E2 with the adhesive 9*a*. Specifically, when the voice coil bobbin 7 and the like are assumed to move in the direction of an arrow Y2 with the large magnitude, the portion of the damper 6 corresponding to the area E4 is positioned at a damper 6*y*, for example. On the contrary, when the voice coil bobbin 7 and the like are assumed to move in the direction of the arrow Y3 with the large magnitude, the portion of the damper 6 corresponding to the area E4 is positioned at a damper 6*x*, for example. Due to this, the damper 6 may be problematically cut in the vicinity of the broken line portion E2, or the portion of the damper 6 corresponding to the area E5 may problematically peel off the adhesive 9*a*. In addition, since the adhesion area between each of the inner peripheral edge portions of the damper 6 and the diaphragm 11 and the outer peripheral wall of the voice coil 8 is not so large, the bonding strength therebetween is not so strong. Therefore, the adhesive among the voice coil bobbin 7 including the voice coil 8, the damper 6 and the diaphragm 11 may peel off, and the voice coil bobbin 7 including the voice coil 8 may problematically peel off the damper 6 and the diaphragm 11.

On the other hand, in the speaker device 100 of the present invention, as shown in FIG. 3A, when the voice coil bobbin 7 and the like are assumed to move in the direction of the arrow Y1 at the time of the driving the speaker device, the inner peripheral edge portion of the damper 6 accordingly moves to the positions of the dampers 6*x* and 6*y*, respectively, similarly to the comparative example. In addition, in FIG. 3A, while the portion of the damper 6 corresponding to the area E5 is fixed by the adhesive 9*a*, the portion of the damper 6 corresponding to the area E4 is not fixed by the adhesive 9*a*. Therefore, in the present invention, when the voice coil bobbin 7 and the like move with the large magnitude, the damper 6 widely moves in the direction of the arrow Y1 with respect to the vicinity of the broken line area E3.

However, in the first embodiment of the present invention, since the upper surface of the flat portion 6*a* of the damper 6 contacts the lower surface 10*cb* of the flange portion 10*c* of the annular member 10, the adhesive 9*a* filled into the gap 70 does not structurally flow out to the side of the outer peripheral edge portion 10*ca* of the annular member 10. Therefore, even when the voice coil bobbin 7 and the like move in the direction of the arrow Y1 with the large magnitude, it never happens that the damper 6 problematically peels off the adhesive 9*a*.

In addition, in the first embodiment, when the voice coil bobbin 7 and the like are assumed to move in the direction of the arrow Y3 with the large magnitude, the portion of the damper 6 corresponding to the area E4 is positioned at the damper 6*x*. At this time, since the outer peripheral edge portion 10*ca* of the lower surface 10*cb* of the annular member 10 is formed into the chamfered curve shape, the flat portion 6*a* of the damper 6 in the vicinity of the broken line area E3 moves along the shape of the outer peripheral edge portion 10*ca*. Therefore, in this case, it never happens that the damper 6 is problematically cut in the vicinity of the broken line area E3.

Further, in the first embodiment, since the annular member 10 is arranged between the inner peripheral edge portion of the damper 6 and the inner peripheral edge portion of the diaphragm 11, the adhesion area of the adhesives 9*a*, 9*b* and 9*c*, applied among the damper 6, the annular member 10, the diaphragm 11 and the outer peripheral wall of the voice coil 8 becomes the value obtained by multiplying the length D2 by the length of the outer circumference of the voice coil 8, as described above. On the contrary, in the comparative example, the adhesion area of the adhesives 9*a* and 9*c* applied between the damper 6 and the diaphragm 11 and between the diaphragm 11 and the outer peripheral wall of the voice coil 8 becomes the value obtained by multiplying the length D1 (<D2) by the length of the outer circumference of the voice coil 8, as described above. Thus, in the first embodiment, the adhesion area of the adhesive applied between the damper 6 and the voice coil 8 becomes larger than the adhesion area of the comparative example, and the adhesion strength is large. Hence, even when the voice coil bobbin 7 and the like move in the direction of the arrow Y1 with the large magnitude, the adhesives 9*a*, 9*b* and 9*c* applied among the voice coil bobbin 7 including the voice coil 8, the damper 6, the annular member 10 and the diaphragm 11 hardly peel off, and it can be prevented that the voice coil bobbin 7 including the voice coil 8 problematically peels off the damper 6, the annular member 10 and the diaphragm 11.

Therefore, the speaker device 100 according to the first embodiment of the present invention can improve the withstand input performance, and can be preferably used as the so-called subwoofer-type speaker device.

Second Embodiment

Next, the description will be given of the mounting structure of the damper 6 according to a second embodiment of the present invention, with reference to FIGS. 4A to 4C and FIG. 5.

The second embodiment is characterized in that electrical connection between each tinsel cord and each lead wire of the voice coil is facilitated by providing plural groove portions (cut-out portions) on the annular member 10 of the first embodiment. The configuration of the second embodiment, other than this point, is substantially similar to the configuration of the first embodiment. Therefore, the same reference numerals are given to the same components as the components of the first embodiment, and the explanation thereof will be simplified or omitted, below.

Figure 4B:
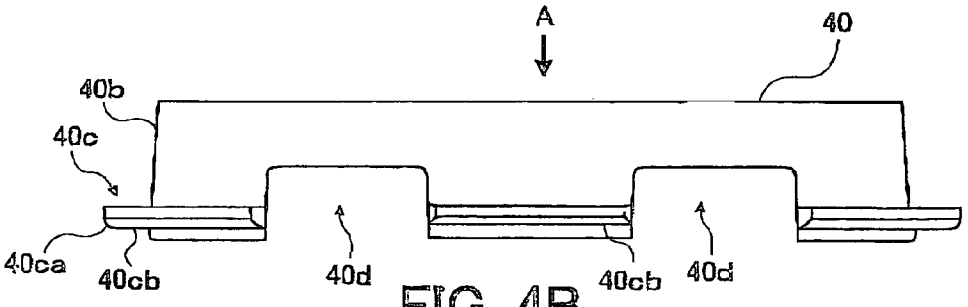
FIGS. 4A to 4C show a perspective view, a side view and a plan view of an annular member having groove portions of the present invention.
Figure 4C:
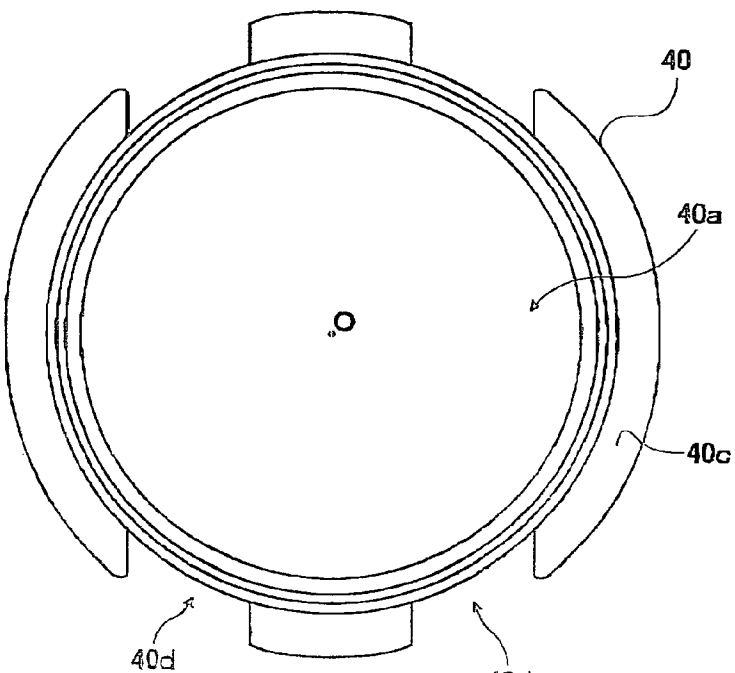
Figure 4A:
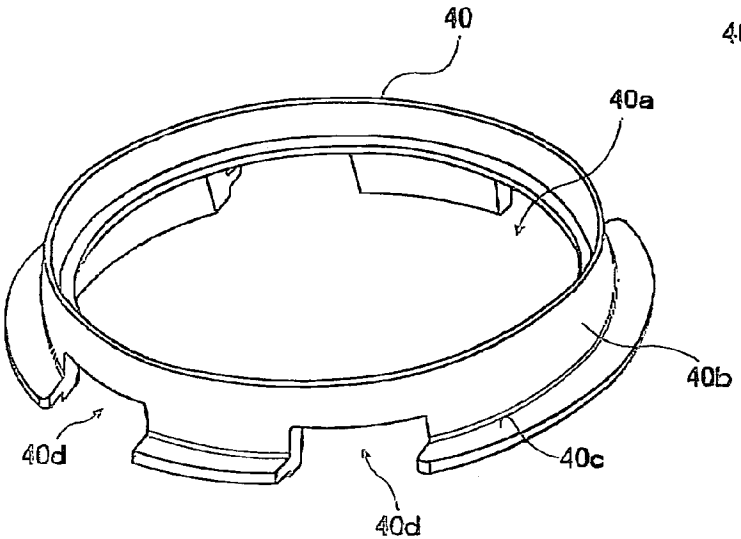
Figure 5:
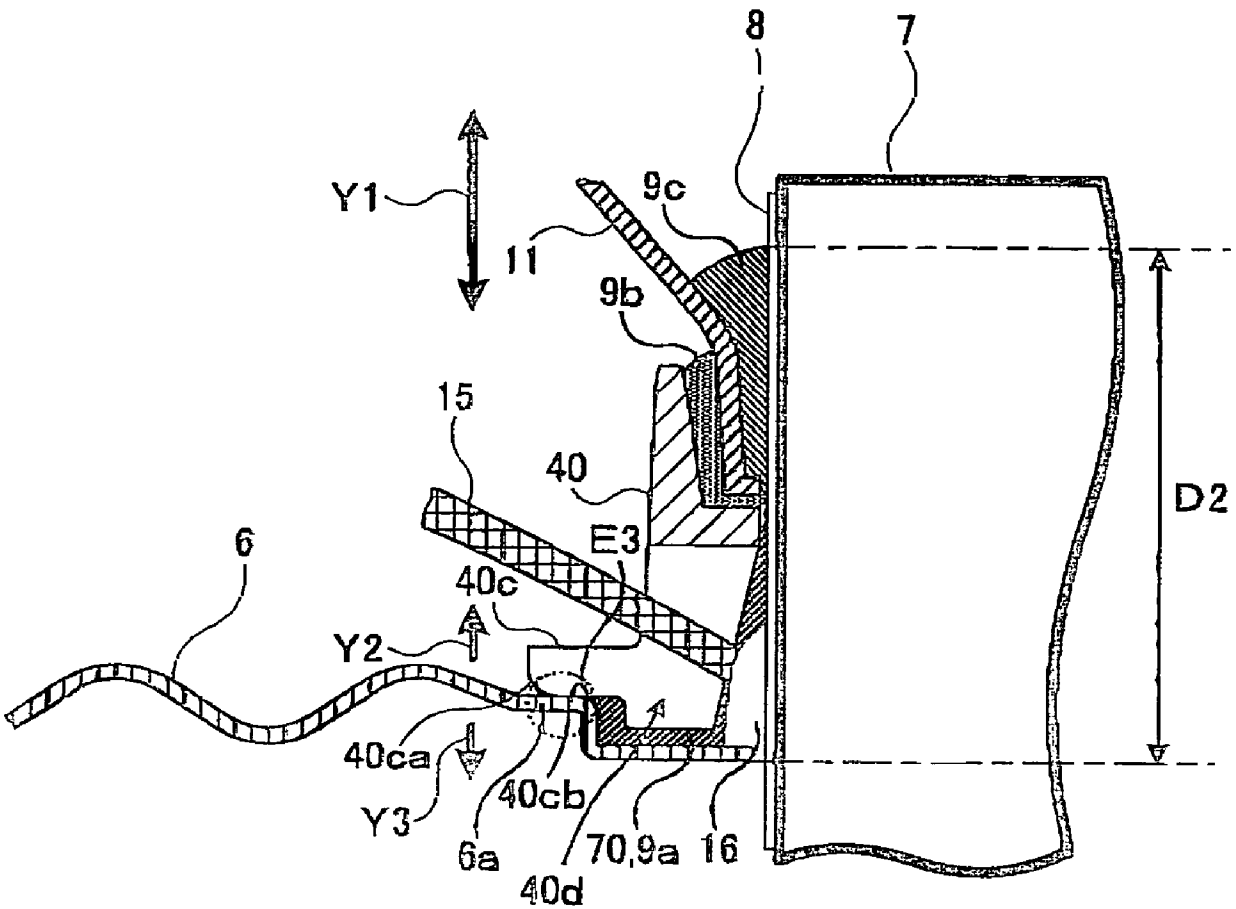
FIG. 5 shows a cross-sectional view of the mounting structure of the damper and the like according to a second embodiment.

FIGS. 4A to 4C show the configuration of an annular member 40 according to the second embodiment. FIG. 4R shows a perspective view of the annular member 40, FIG. 4B shows a side view of the annular member 40, and FIG. 4C shows a plan view of the annular member 40 of FIG. 4B observed in the direction of the arrow A, respectively. FIG. 5 is a partly cross-sectional view corresponding to FIG. 3A of the first embodiment, which shows the mounting structure of the damper 6 of the second embodiment. First, the configuration of the annular member 40 will be explained with reference to FIGS. 4A to 4C.

The annular member 40 has an opening 40*a*, a raised wall 40*b*, a flange portion 40*c*, and further plural groove portions 40*d*. The opening 40*a*, the raised wall 40*b* and the flange portion 40*c* substantially correspond to the opening 10*a*, the raised wall 10*b* and the flange portion 10*c* of the first embodiment. Particularly, on the annular member 40 of the second embodiment, the plural groove portions 40*d* are formed by cutting out portions from a substantially middle portion of the raised wall 40*b* to the flange portion 40*c*. The groove portions 40*d* are partly and discontinuously formed along the circumferential direction of the annular member 40. Into the groove portions 40*d*, tinsel cords (not shown) are inserted.

Next, the description will be given of the mounting structure of the damper 6 of the second embodiment with reference to FIG. 5. As shown in FIG. 5, the groove portions 40*d* are provided on the annular member 40 arranged between the inner peripheral edge portion of the damper 6 and the inner peripheral edge portion of the diaphragm 11. Into each of the groove portions 40*d*, the correspondent tinsel cord 15 is inserted, and one end side of the tinsel cord 15 is electrically connected to the lead wire not shown of the voice coil 8 via a solder 16. The other end side of the tinsel cord 15 is electrically connected to the terminal member 5 not shown (see FIG. 1). Therefore, when the input signal from the amplifier is outputted to the terminal member 5, the output signal is outputted to the voice coil 8 via the tinsel cord 15. Like this, in the second embodiment, since the plural groove portions 40*d* are provided on the annular member 40, there is such an advantage that the tinsel cord 15 and the lead wire of the voice coil 8 can be easily electrically connected via the solder 16 at the time of manufacturing the speaker device. The operation and effect of the present invention in the second embodiment are similar to the operation and effect of the first embodiment, and an explanation thereof is omitted.

Third Embodiment

Figure 6B:
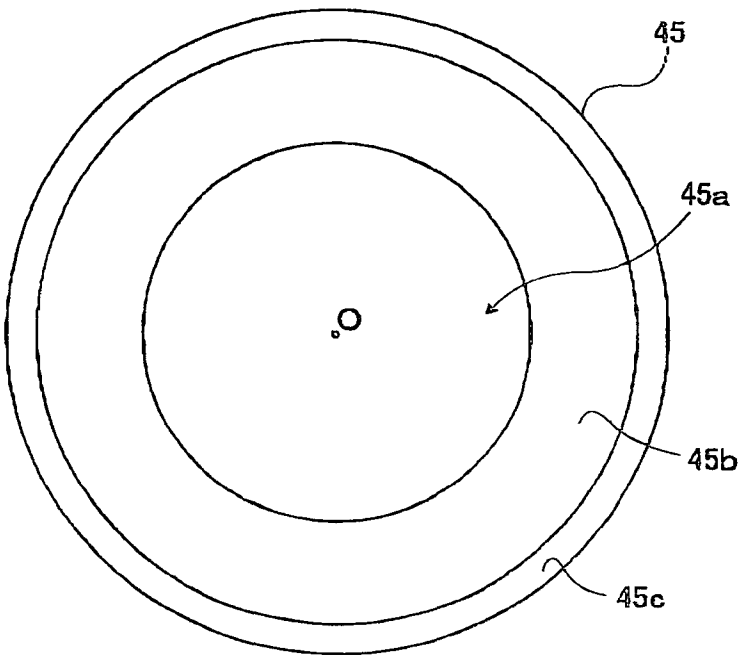
FIGS. 6A and 6B show a cross-sectional view and a plan view of one additional annular member of the present invention.
Figure 6A:
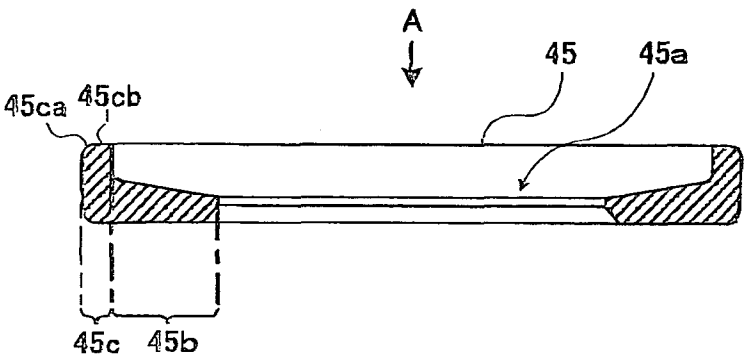
Figure 7:
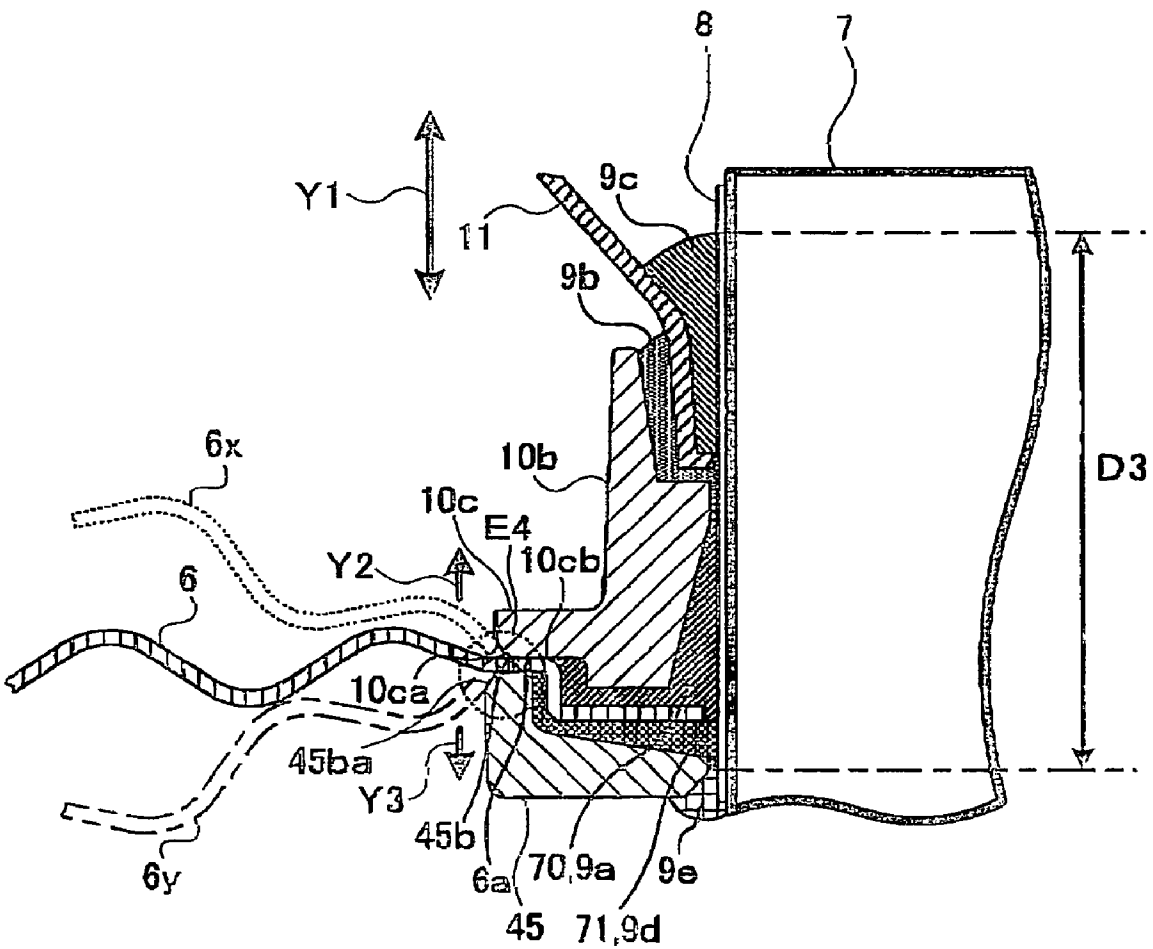
FIG. 7 shows a cross-sectional view of the mounting structure of the damper and the like according to a third embodiment.

Next, the description will be given of the mounting structure of the damper 6 according to a third embodiment of the present invention with reference to FIGS. 6A and 6B and FIG. 7.

The basic configuration of the third embodiment is similar to the configuration of the first embodiment. However, the third embodiment has a characteristic in that one additional annular member 45 other than the annular member 10 is particularly provided on the lower side of the damper 6 and the inner peripheral edge portion of the damper 6 is sandwiched by the annular member 45 and the annular member 10. Thus, the same reference numerals are given to the same components as the components of the first embodiment, and an explanation thereof is omitted below. FIGS. 6A and 6B show the configuration of the additional annular member 45 according to the third embodiment. FIG. 6A shows a cross-sectional view of the annular member 45 when cutting the annular member 45 by a plane including a central axis thereof, and FIG. 6B shows a plane view of the annular member 45 observed in the direction of the arrow A of FIG. 6A, respectively.

First, the configuration of the annular member 45 will be explained with reference to FIGS. 6A and 6B.

The annular member 45 has an opening 45*a*, a first portion 45*b* formed into an annular shape, a second portion 45*c* extending upward from an outer peripheral edge portion of the first portion 45*b*. An upper surface 45*cb* of the second portion 45*c* has flatness, and an outer peripheral edge portion 45*ca* of the upper surface 45*cb* is chamfered to be formed into a curve shape.

Next, the mounting structure of the damper 6 of the third embodiment will be explained with reference to FIG. 7. Since the basic configuration of the third embodiment is substantially similar to the configuration of the first embodiment, the description will be mainly given of a function and the like of the annular member 45, below.

Particularly, in the third embodiment, the annular member 45 is mounted on the lower side of the inner peripheral edge portion of the damper 6. The annular member 45 is positioned at an appropriate position of the outer peripheral wall of the voice coil 8 by an adhesive 9*e* for temporary attachment to be mounted thereon, and the upper surface 45*cb* of the annular member 45 contacts the lower surface of the flat portion 6*a* of the damper 6. In addition, a gap 71 is formed among the annular member 45, the inner peripheral edge portion of the damper 6 opposite to the annular member 45 and the outer peripheral wall of the voice coil 8, and an adhesive 9*d* is filled into the gap 71. Therefore, the annular member 45, the inner peripheral edge portion of the damper 6 and the outer peripheral wall of the voice coil 8 are bonded via the adhesive 9*d*, respectively. According to the above-mentioned configuration, the flat portion 6*a* of the damper 6 corresponding to the broken line area E4 is sandwiched by the lower surface 10*cb* of the annular member 10 and the upper surface 45*cb* of the annular member 45.

Thereby, the adhesive 9*d* filled into the gap 71 does not structurally flow out to the side of the outer peripheral edge portion 45*ca* of the upper surface 45*cb* of the annular member 45. Thus, even when the voice coil bobbin 7 and the like move in the direction of the arrow Y1 with the large magnitude, it never happens that the damper 6 problematically peels off the adhesive 9*d*. In addition, the adhesion area of the adhesives 9*a* to 9*d* applied among the annular member 45, the damper 6 the annular member 10, the diaphragm 11 and the outer peripheral wall of the voice coil 8 becomes approximately the value obtained by multiplying a length D3 (>D2) from the vicinity of the inner peripheral edge portion of the diaphragm 11 to the inner peripheral edge portion of the annular member 45 by the length of the outer circumference of the voice coil 8. Hence, the adhesion area in the third embodiment becomes larger than the adhesion area in the first embodiment.

According to the above-mentioned configuration, in the third embodiment, the operation and effect similar to those of the first embodiment can be obtained. Additionally, in the third embodiment, the annular member 45 is mounted on the lower side of the inner peripheral edge portion of the damper 6 and the outer peripheral edge portion 45*ca* or the lower surface 45*cb* of the annular member 45 is formed into the chamfered curve shape. Therefore, when the voice coil bobbin 7 and the like move in the direction of the arrow Y2 with the large magnitude, the flat portion 6*a* of the damper 6 in the vicinity of the broken line area E4 moves along the shape of the outer peripheral edge portion 45*ca*. Thus, in the third embodiment, even when the voice coil bobbin 7 and the like move in both directions of the arrows Y2 and Y3, it never happens that the damper 6 is problematically cut in the vicinity of the flat portion 6*a* of the damper 6.

As described above, in the third embodiment, in addition to the annular member 10, the annular member 45 is provided. Therefore, by the amount of the annular member 45, the adhesion area of the adhesives 9*d*, 9*a*, 9*b* and 9*c* applied among the annular member 45, the damper 6, the annular member 10, the diaphragm 11 and the outer peripheral wall of the voice coil 8 becomes larger than the adhesion area in the first embodiment. Thus, in the third embodiment, even when the voice coil bobbin 7 and the like move in the direction of the arrow Y1 with the large magnitude, the adhesives 9*d*, 9*a*, 9*b* and 9*c* among the voice coil bobbin 7 including the voice coil 8, the annular member 45, the damper 6, the annular member 10 and the diaphragm 11 further hardly peel in comparison with the adhesives of the first and second embodiments. Therefore, it can be prevented that the voice coil bobbin 7 including the voice coil 8 problematically peels off the annular member 45, the damper 6, the annular member 10 and the diaphragm 11.

[Manufacturing Method of Speaker Device]

Figure 8:
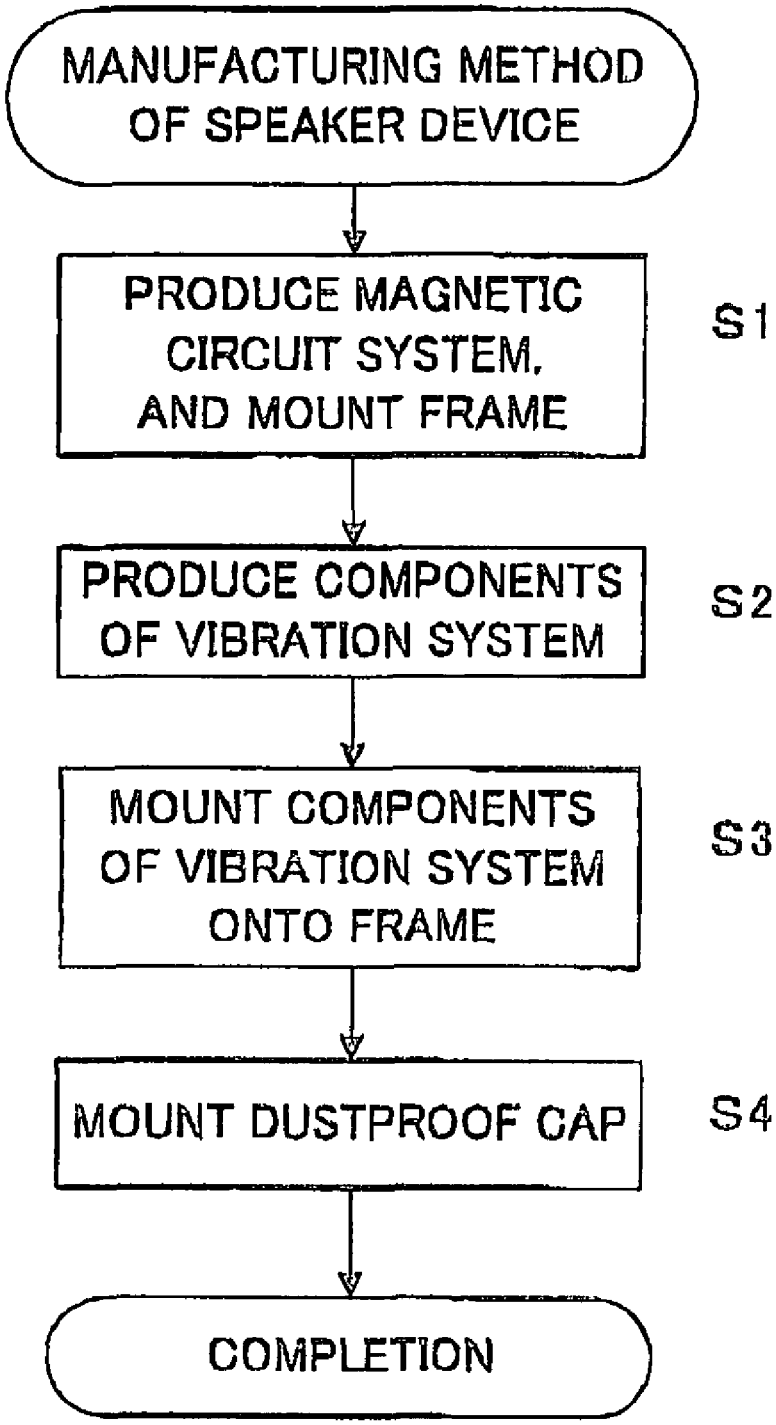
FIG. 8 shows a flow chart of a manufacturing method of the speaker device of the present invention.
Figure 13:
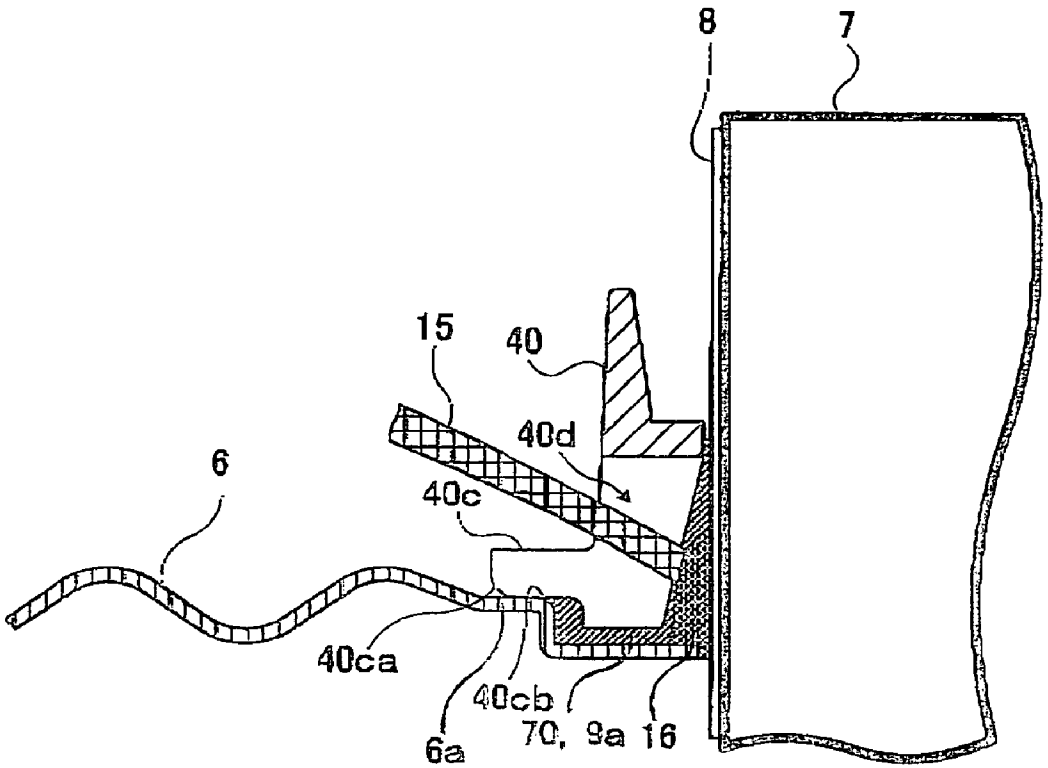
FIG. 13 schematically shows a cross-sectional view of the manufacturing process of the speaker device according to the second embodiment.
Figure 14B:
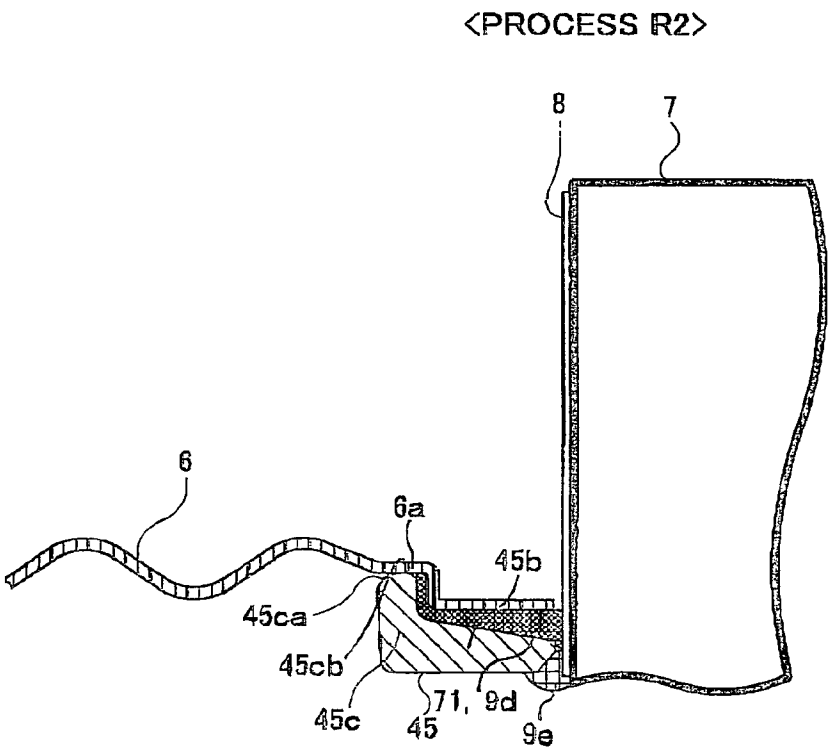
FIGS. 14A and 14T schematically show cross-sectional views of the respective manufacturing processes of the speaker device according to the third embodiment.
Figure 14A:
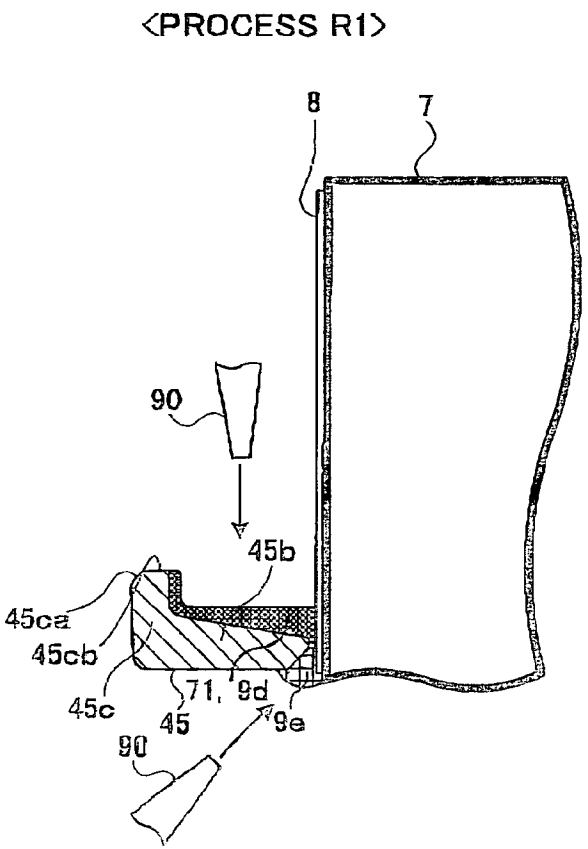

Next, a manufacturing method of the speaker device 100 will be explained with reference to FIG. 8 to FIGS. 14A and 14B. FIG. 8 shows a flow chart of the manufacturing method of the speaker device 100. FIG. 9 to FIG. 12 are cross-sectional views of respective processes corresponding to the flow chart of FIG. 8, which correspond to the manufacturing method of the speaker device of the first embodiment. FIG. 13 is a cross-sectional view corresponding to one part of the process of the manufacturing method of the speaker device of the second embodiment. FIGS. 14A and 14B are cross-sectional views corresponding to one part of the process of the manufacturing method of the speaker device of the third embodiment.

Figure 9:
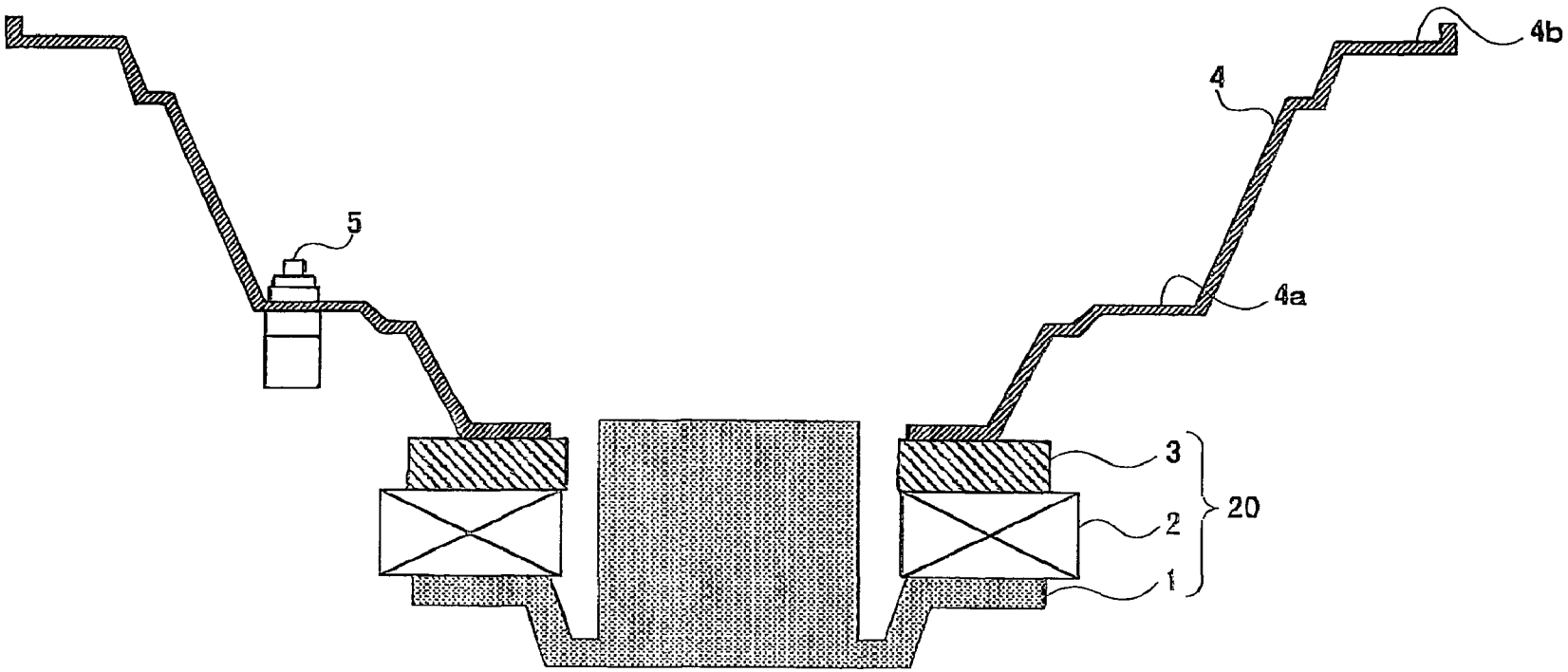
FIG. 9 schematically shows a cross-sectional view of a manufacturing process of the speaker device including the first embodiment.

First, the magnetic circuit system 20 is manufactured and mounted onto the frame 4 (step S1). Namely, as shown in FIG. 9, by a known method, the magnet 2 is fixed onto the yoke 1, and the plate 3 is fixed onto the magnet 2. In such a method, the magnetic circuit system 20 is manufactured. Next, the magnetic circuit system 20 is mounted onto the frame 4.

Next, the components of the vibration system being the characteristic of the present invention are manufactured (step S2). Specifically, as shown in FIG. 10A, first, the voice coil 8 is wound around the voice coil bobbin 7. Next, as shown in FIG. 10A, the inner peripheral edge portion of the damper 6 is mounted onto the outer peripheral wall of the voice coil 8, and the adhesive 9*a* is applied between the inner peripheral edge portion of the damper 6 and the voice coil 8 by an adhesive applying device 90. In such a method, the inner peripheral edge portion of the damper 6 is fixed onto the outer peripheral wall of the voice coil 8 (damper fixing process).

Figure 10B:
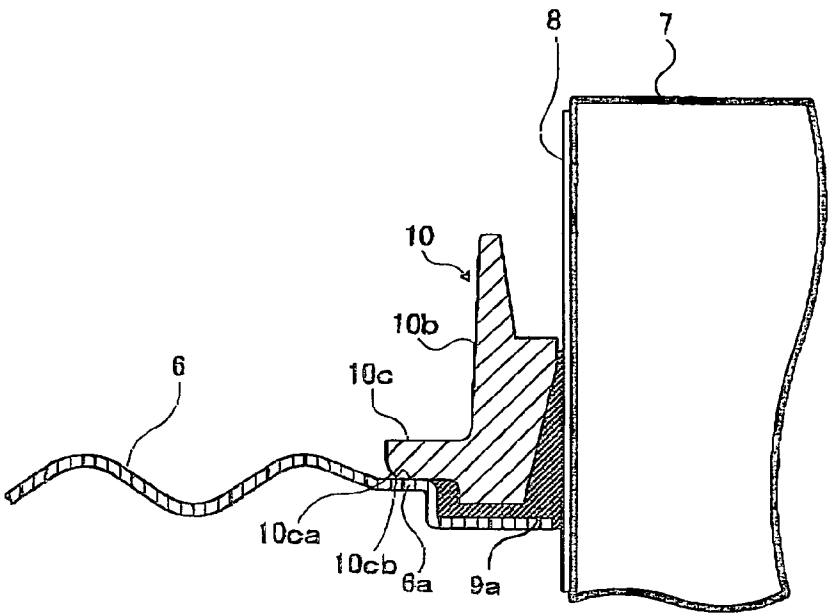
FIGS. 10A and 10B schematically show cross-sectional views of the respective manufacturing processes of the speaker device including the first embodiment.
Figure 10A:
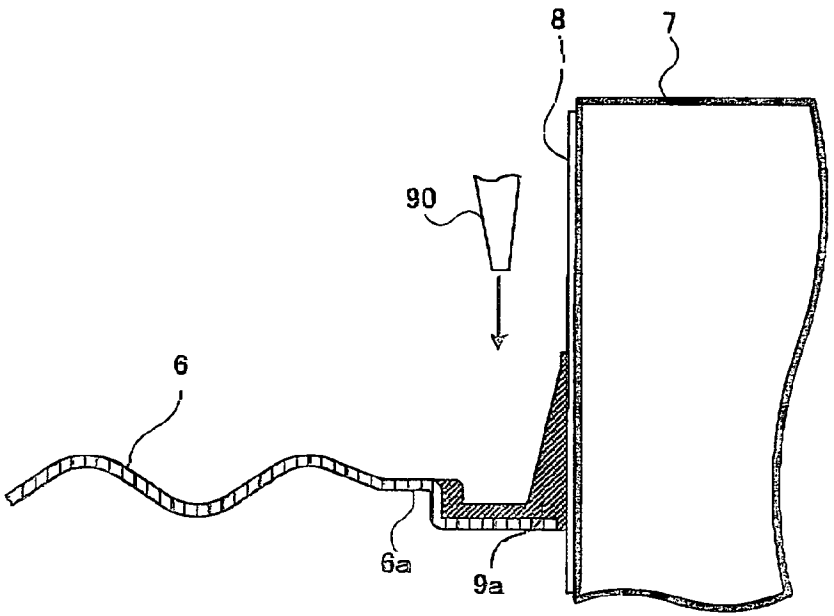
Figure 11B:
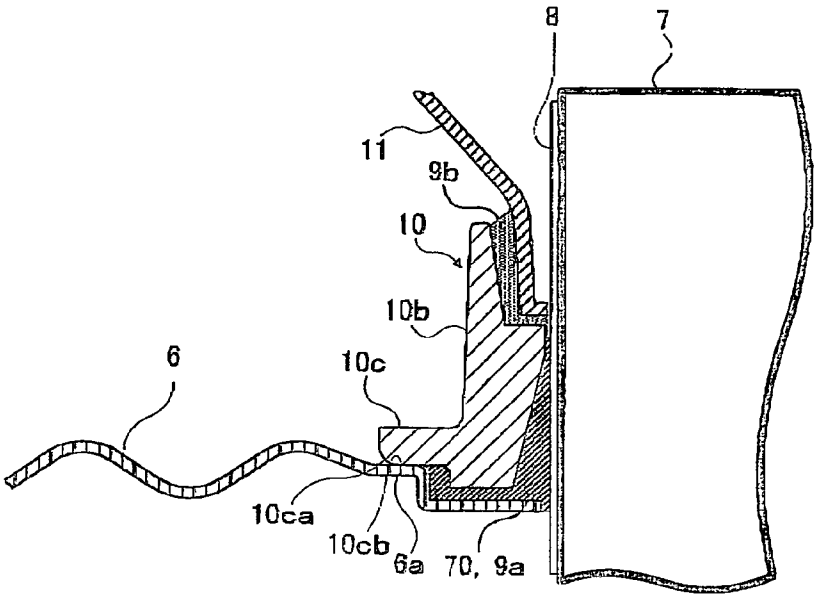
FIGS. 11A and 11B schematically show cross-sectional views of the respective manufacturing processes of the speaker device including the first embodiment.
Figure 11A:
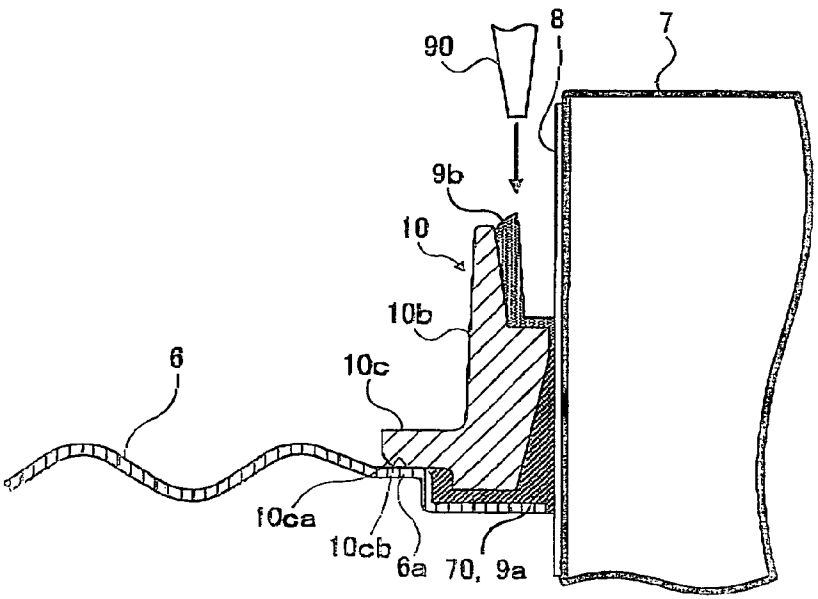

Subsequently, as shown in FIG. 10B, the annular member 10 is arranged on the upper side of the inner peripheral edge portion of the damper 6, and the upper surface of the flat portion 6*a* of the damper 6 and the lower surface 10*cb* of the flange portion 10*c* of the annular member 10 are contacted. In such a method, the annular member 10 is mounted onto the outer peripheral wall of the voice coil 8 by the adhesive 9*a* (fixing process of the annular member 10). Next, as shown in FIG. 11A, the adhesive 9*b* is applied to the one portion of the inner peripheral portion and the upper surface of the raised wall 10*b* of the annular member 10 by the adhesive applying device 90. Then, as shown in FIG. 11B, the inner peripheral edge portion of the diaphragm 11 is arranged on the upper side of the annular member 10, and the annular member 10 and the inner peripheral edge portion of the diaphragm 11 are bonded by the adhesive 9*b*.

Figure 12:
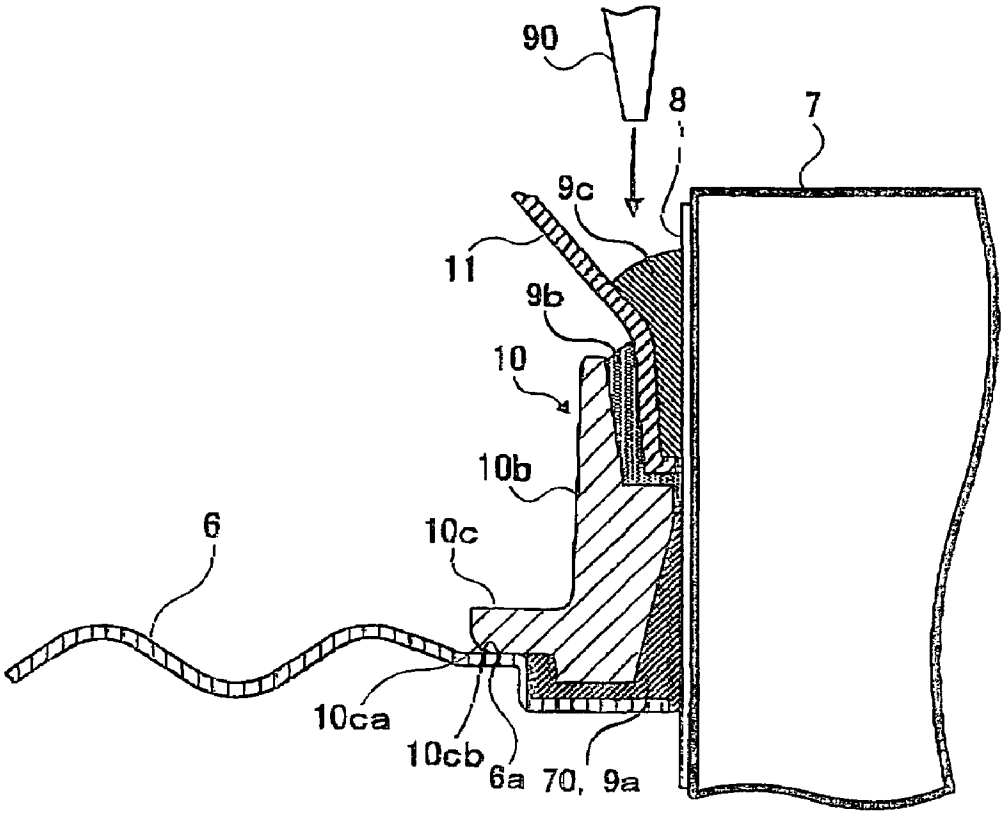
FIG. 12 schematically shows a cross-sectional view of the manufacturing process of the speaker device including the first embodiment.

Next, as shown in FIG. 12, the adhesive 9*c* is applied between the inner peripheral edge portion of the diaphragm 11 and the outer peripheral wall of the voice coil 8 by the adhesive applying device 90, and the inner peripheral edge portion of the diaphragm 11 and the outer peripheral wall of the voice coil 8 are bonded (diaphragm fixing process). In such a method, the components of the vibration system having the characteristic of the present invention are manufactured.

Next, by the known method, the components of the vibration system are mounted on the frame 4 (step S3), and the dustproof cap 12 is mounted on the inner peripheral portion of the diaphragm 11 (step S4). In such a method, the speaker device 100 according to the first embodiment shown in FIG. 1 is manufactured.

Next, the description will be given of the manufacturing method of the speaker device according to the second embodiment with reference to FIG. 13. The manufacturing method is substantially similar to the manufacturing method of the speaker device according to the above-mentioned first embodiment. However, the manufacturing method of the speaker device according to the second embodiment is different from the manufacturing method of the speaker device according to the first embodiment in that the speaker device is manufactured by using the annular member 40 having the plural groove portions 40*d*. Therefore, the manufacturing method of the speaker device according to the second embodiment has a connecting process of electrically connecting the plural tinsel cords and the voice coil between the above-mentioned fixing process of the annular member 10 and the diaphragm fixing process. FIG. 13 shows the sectional view corresponding to the connecting process. The explanation of the process explained in the first embodiment is omitted below, in order to avoid the repeated explanation.

In the manufacturing method of the speaker device according to the second embodiment, between the fixing process of the annular member 10 and the diaphragm fixing process, as shown in FIG. 13, the plural tinsel cords 15 electrically connected to the amplifier are inserted into the plural correspondent groove portions 40*d* of the annular member 40, and the one end sides of the plural tinsel cords 15 are electrically connected to the plural correspondent lead wires of the voice coil 8 via the solder 16. Thereby, the plural tinsel cords 15 and the voice coil 8 can be easily electrically connected. Next, by executing the above diaphragm fixing process, the speaker device according to the second embodiment is manufactured.

Next, the description will be given of the manufacturing method of the speaker device according to the third embodiment with reference to FIGS. 14A and 14B. The manufacturing method is substantially similar to the above-mentioned manufacturing method of the speaker device of the first embodiment. However, the manufacturing method of the speaker device according to the third embodiment has the fixing process of the annular member 45 in which the annular member 45 is mounted onto the voice coil 8 in the preceding process of the above-mentioned damper fixing process. In this point, the manufacturing method according to the third embodiment is different from the manufacturing method according to the first embodiment. FIGS. 14A and 14B show respective cross-sectional views corresponding to fixing processes R1 and R2 of the annular member 45. It is noted that the fixing process R2 of the annular member 45 is included in the above-mentioned damper fixing process. In addition, the explanation of the process given in the first embodiment will be omitted below, in order to avoid the repeated explanation.

In the manufacturing method of the speaker device according to the third embodiment, first, as shown in FIG. 14A, the annular member 45 is arranged on the outer peripheral wall of the voice coil 8 corresponding to the lower side of the damper 6 (not shown, see FIG. 7) in the fixing process R1 of the annular member 45 as the preceding process of the damper fixing process. At the same time, the adhesive 9*e* for temporary attachment is applied between the inner peripheral edge portion on the side of the lower surface of the annular member 45 and the outer peripheral wall of the voice coil 8 by the adhesive applying device 90, and the annular member 45 is temporarily attached to the appropriate position of the outer peripheral wall of the voice coil 8. Subsequently, the adhesive 90*d* is applied to the upper surface of the first portion 45*b* and the inner peripheral portion of the second portion 45*c* of the annular member 45 and the outer peripheral wall of the voice coil 8 in the vicinity of the inner peripheral edge portion of the annular member 45 by the adhesive applying device 90.

Next, as shown in FIG. 14B, in the fixing process R2 of the annular member 45, the damper 6 is arranged on the upper side of the annular member 45, and the upper surface of the second portion 45*c* of the annular member 45 and the lower surface of the flat portion 6*a* of the damper 6 are contacted. At the same time, the annular member 45 and the damper 6 are bonded together by the adhesive 9*d*. Next, by executing the above-mentioned fixing process of the annular member 10 and the above-mentioned diaphragm fixing process, the speaker device according to the third embodiment is manufactured.

[Modification]

In the speaker devices and the correspondent manufacturing methods according to the above-mentioned first and second embodiments, the damper 6, the annular member 10 and the diaphragm 11 are fixed to the outer peripheral wall of the voice coil bobbin 7 via the voice coil 8 by the adhesive. In addition, in the speaker device and the correspondent manufacturing method according to the third embodiment, the annular member 45, the damper 6, the annular member 10 and the diaphragm 11 are fixed to the outer peripheral wall of the voice coil bobbin 7 via the voice coil 8 by the adhesive. However, application of the present invention is not limited to this. Namely, in the present invention, each component may be structurally directly fixed to the outer peripheral wall of the voice coil bobbin 7 by the adhesive.

In addition, in the speaker device and the correspondent manufacturing method according to the third embodiment, the annular member 10 is applied. Instead of this, the annular member 40 according to the second embodiment may be applied.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to embraced therein.

The entire disclosure of Japanese Patent Application No. 2004-309794 filed on Oct. 25, 2004 including the specification, claims, drawings and summary is incorporated herein by reference in its entirety.

What is claimed is:

1. A speaker device comprising:

a voice coil bobbin;

a diaphragm which is fixed to the voice coil bobbin via an adhesive;

a damper; and an annular member, wherein the annular member is arranged between the diaphragm and the damper, wherein a gap is formed among the damper, the annular member and the voice coil bobbin, and the adhesive is filled into the gap, and wherein the damper and the annular member contact at an outer peripheral position of the annular member adjacent to the gap via no adhesive.

2. The speaker device according to claim 1, further comprising one additional annular member which is arranged on a side opposite to the annular member with respect to the damper, and which is fixed to the voice coil bobbin via an adhesive, wherein one additional gap is formed among the damper, the additional annular member and the voice coil bobbin, and the adhesive is filled into the additional gap, wherein the damper and the additional annular member contact at an outer peripheral position of the additional annular member adjacent to the other gap via no adhesive, and wherein the damper is sandwiched by the annular member and the additional annular member at the outer peripheral positions of the annular member and the additional annular member.

3. The speaker device according to claim 2, wherein sections of the outer peripheral portion of the annular member and the outer peripheral portion of the additional annular member, contacting the damper, are formed into curve shapes, respectively.

4. The speaker device according to claim 1, further comprising:

plural tinsel cords which supply an electric signal; and a voice coil which is wound around the voice coil bobbin, wherein plural groove portions are formed on the annular member, and wherein the plural tinsel cords are inserted into plural correspondent groove portions and are electrically connected to the voice coil.

5. The speaker device according to claim 2, wherein the diaphragm, the damper, the annular member and the additional annular member are fixed to the voice coil bobbin via the voice coil by the adhesive, respectively.

* * * * *